US006836104B2

(12) United States Patent
Yoshihara

(10) Patent No.: US 6,836,104 B2
(45) Date of Patent: Dec. 28, 2004

(54) INTERNAL POWER SUPPLY VOLTAGE CONTROL APPARATUS HAVING TWO INTERNAL POWER SUPPLY REFERENCE VOLTAGE GENERATING CIRCUITS

(75) Inventor: Kazuo Yoshihara, Kanagawa (JP)

(73) Assignee: NEC Electronics Corporation, Kanagawa (JP)

( * ) Notice: Subject to any disclaimer, the term of this patent is extended or adjusted under 35 U.S.C. 154(b) by 0 days.

(21) Appl. No.: 10/422,518

(22) Filed: Apr. 24, 2003

(65) Prior Publication Data

US 2003/0214278 A1 Nov. 20, 2003

(30) Foreign Application Priority Data

May 14, 2002 (JP) ..... 2002-139215

(51) Int. Cl.[7] ..... G05F 3/16
(52) U.S. Cl. ..... 323/314
(58) Field of Search ..... 323/313, 314

(56) References Cited

U.S. PATENT DOCUMENTS 5,592,121 A * 1/1997 Jung et al. ..... 327/541
5,751,142 A * 5/1998 Dosho et al. ..... 323/316
5,973,484 A * 10/1999 Cho ..... 323/269
6,297,624 B1 * 10/2001 Mitsui et al. ..... 323/316
6,515,461 B2 * 2/2003 Akiyama et al. ..... 323/313
6,683,445 B2 * 1/2004 Park ..... 323/315
6,710,586 B2 * 3/2004 Yamamoto ..... 323/313

FOREIGN PATENT DOCUMENTS

JP 3-160699 7/1991 ..... G11C/29/00
JP 11-353036 12/1999 ..... G05F/1/00
JP 2000-156097 6/2000 ..... G11C/29/00

* cited by examiner

*Primary Examiner*—Jeffrey Sterrett
(74) *Attorney, Agent, or Firm*—Choate, Hall & Stewart

(57) ABSTRACT

In an internal power supply voltage control apparatus, reference voltage generating circuit generates a reference voltage. A first internal power supply reference voltage generating circuit generates a first internal power supply reference voltage in accordance with the reference voltage, and a second internal power supply reference voltage generating circuit generates a second internal power supply reference voltage in accordance with a voltage applied to a predetermined pad. A test mode selecting circuit activates one of the first and second internal power supply reference voltage generating circuits in accordance with a control signal. An internal power supply voltage generating circuit generates an internal power supply voltage in accordance with one of the first and second internal power supply reference voltages generated from an activated one of the first and second internal power supply reference voltage generating circuits.

10 Claims, 9 Drawing Sheets

INTERNAL POWER SUPPLY VOLTAGE CONTROL APPARATUS HAVING TWO INTERNAL POWER SUPPLY REFERENCE VOLTAGE GENERATING CIRCUITS

BACKGROUND OF THE INVENTION

1. Field of the Invention

The present invention relates to an internal power supply voltage control apparatus for generating a low voltage and applying it to an internal circuit, and more particularly, to an internal power supply voltage control apparatus capable of carrying out a low voltage margin test and a high voltage margin test such as a burn-in test or a stress test.

2. Description of the Related Art

High speed semiconductor memory devices have recently been used in personal computers and workstations.

In response to demands for a lower power supply voltage and a lower power consumption, a high speed semiconductor memory device is divided into a peripheral circuit operated directly by an external power supply voltage and an internal circuit having low breakdown voltage characteristics operated by a voltage lower than the external voltage.

In order to perform a voltage margin test upon the above-mentioned internal circuit, various internal power supply voltage generating apparatuses have been suggested.

In a first prior art internal power supply voltage control apparatus (see: JP-A-2000-156097), a reference voltage generating circuit receives a control signal supplied from an externally-provided pad to generate a reference voltage which is supplied to an internal power supply reference voltage generating circuit for generating an internal power supply reference voltage in accordance with the reference voltage. The internal power supply reference voltage is further supplied to an internal power supply voltage generating circuit for generating an internal power supply voltage in accordance with the internal power supply reference voltage. This will be explained later in detail.

In the above-described first internal power supply voltage control apparatus, however, since the externally-provided pad for the control signal is necessary, the apparatus would be increased in size. Also, it is impossible to accurately confirm the actual internal power supply voltage for the low voltage margin test mode. Further, since the internal power supply voltage for the low voltage margin test mode is fixed, it is impossible to determine a lower limit of the low voltage margin test mode. Additionally, since the internal power supply voltage cannot be higher than the external voltage, a high voltage margin test such as a burn-in test or a stress test cannot be performed upon the internal circuit.

In a second prior art internal power supply voltage control apparatus (see: JP-A-5-33116), an internal power supply voltage generating circuit for generating an internal power supply voltage for a normal operation mode and an externally-provided pad to which an internal power supply voltage for a voltage margin test mode is applied are switched by a selecting circuit. Thus, since the internal power supply voltage for a voltage margin test mode can be changed, not only a lower limit of the low voltage margin test mode but also a higher limit of the high voltage margin test mode can be determined. This also will be explained later in detail.

In the above-described second prior art internal power supply voltage control apparatus, however, since the two externally-provided pads are necessary, the apparatus would be increased in size.

In the above-described second prior art internal power supply voltage control apparatus, the control signal can be supplied from an address input pad (see: JP-A-3-160699); in this case, the number of externally-provided pads can be decreased. However, the externally-provided pad for the control signal is still necessary.

In a third prior art internal power supply voltage control apparatus, the first prior art internal power supply voltage control apparatus is combined with the second prior art internal power supply control apparatus. This also will be explained later in detail.

Even in the above-described third prior art internal power supply voltage control apparatus, however, since the two externally-provided pads for the control signal and the internal power voltage are necessary, the apparatus would be increased in size.

In a fourth prior art internal power supply voltage control apparatus, the selecting circuit of the third prior art internal power supply voltage control apparatus is replaced by a test mode entry circuit and a test mode selecting circuit. Also, in a voltage margin test mode, the internal power supply reference voltage generating circuit and the internal power supply voltage generating circuit of the third prior art power supply voltage control apparatus are deactivated by a canceling signal of the test mode selecting circuit. In this state, a driver in the internal power supply voltage generating circuit is completely turned ON. Therefore, if a low voltage or a high voltage as a voltage margin test mode is applied to an external pad for the external voltage, such a low voltage or such a high voltage is supplied via the driver to the internal circuit. Thus, an arbitrary voltage margin test can be carried out, without the externally-provided pad for the internal voltage while the externally-provided pad for the control signal is necessary. This also will be explained later in detail.

Thus, in the above-described fourth prior art internal power supply voltage control apparatus, in a voltage margin test mode, since the external voltage can be low or high, not only a low voltage margin test but also a high voltage margin test such as a burn-in test or a stress test can be carried out.

In the above-described fourth prior art internal power supply voltage control apparatus, however, in a voltage margin test mode, a circuit portion such as a peripheral circuit operated directly by the external voltage is also subjected to a low voltage or a high voltage for the voltage margin test mode, so that it is impossible to accurately determine a lower limit of the low voltage margin test mode and an upper limit of the high voltage margin test mode.

In the above-described fourth prior art internal power supply voltage control apparatus, the internal power supply reference voltage of the internal power supply reference voltage generating circuit can be adjusted to be a low voltage or a high voltage. Even in this case, it is impossible to accurately determine a lower limit of the low voltage margin test mode and an upper limit of the high voltage margin test mode.

In a fifth internal power supply voltage apparatus, an internal power supply voltage for a voltage margin test mode is also applied from an externally-provided pad to the internal power supply voltage generating circuit of the fourth internal power supply voltage apparatus. As a result, in a voltage margin test node, the internal power supply reference voltage generating circuit is deactivated, while a low voltage or a high voltage is supplied as the internal power supply voltage to the internal power supply voltage generating circuit. Therefore, the internal power supply voltage is brought close to the above-mentioned low voltage or high voltage as a voltage margin test mode, and thus, an arbitrary voltage margin test can be carried out. This also will be explained later in detail.

In the above-described fifth prior art apparatus, however, after a semiconductor device (chip) is completed, no use is made of the internal power supply voltage due to no wire bonding operation upon the pad thereof, so that a high voltage margin test such as a burn-in test or a stress cannot be carried out.

In a sixth prior art internal power supply voltage control apparatus, a burn-in test mode circuit is incorporated into to the elements of the above-described fifth prior art internal power supply voltage control apparatus. This also will be explained later in detail.

In the above-described sixth prior art internal power supply voltage control apparatus, however, when the breakdown voltage of transistors due to the fluctuation of manufacturing process or the like, the voltage margin in a burn-in test mode and the guaranteed range of operation is decreased, so that it is impossible to surely carry out a burn-in test.

SUMMARY OF THE INVENTION

It is an object of the present invention to provide an internal power supply voltage control apparatus capable of accurately carrying out a voltage margin test without additional externally-provided pads.

According to the present invention, in an internal power supply voltage control apparatus, a reference voltage generating circuit generates a reference voltage. A first internal power supply reference voltage generating circuit generates a first internal power supply reference voltage in accordance with the reference voltage, and a second internal power supply reference voltage generating circuit generates a second internal power supply reference voltage in accordance with a voltage applied to a predetermined pad. A test mode selecting circuit activates one of the first and second internal power supply reference voltage generating circuits in accordance with a control signal. An internal power supply voltage generating circuit generates an internal power supply voltage in accordance with one of the first and second internal power supply reference voltages generated from an activated one of the first and second internal power supply reference voltage generating circuits.

The voltage at the predetermined pad serves as a low voltage or a high voltage for a voltage margin test mode.

BRIEF DESCRIPTION OF THE DRAWINGS

The present invention will be more clearly understood from the description as set forth below, as compared with the prior art, with reference to the accompanying drawings, wherein.

DESCRIPTION OF THE PREFERRED EMBODIMENTS

Before the description of the preferred embodiments, prior art internal power supply voltage control apparatuses will be explained with reference to FIGS. 1, 2, 3, 4, 5 and 6.

Figure 1:
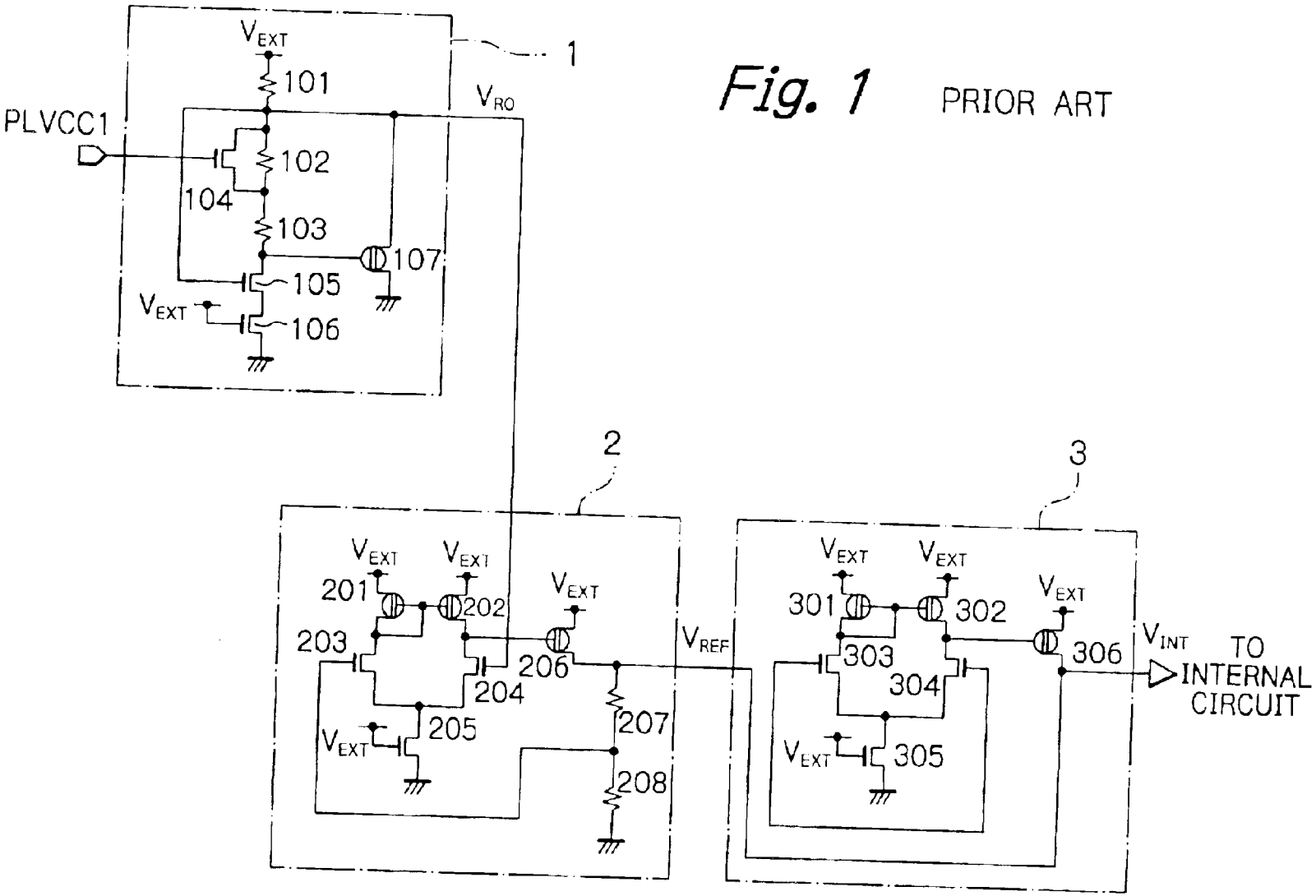
Fig. 1 PRIOR ART
FIG. 1 is a circuit diagram illustrating a first prior art internal power supply voltage control apparatus.

In FIG. 1, which illustrates a first prior art internal power supply voltage control apparatus (see: JP-A-2000-156097), a reference voltage generating circuit 1 receives a control signal PLVCC1 supplied from an externally-provided pad to generate a reference voltage $V_{RO}$ which is supplied to an internal power supply reference voltage generating circuit 2 for generating an internal power supply reference voltage $V_{REF}$ in accordance with the reference voltage $V_{RO}$. The internal power supply reference voltage $V_{REF}$ is further supplied to an internal power supply voltage generating circuit 3 for generating an internal power supply voltage $V_{INT}$ in accordance with the internal power supply reference voltage $V_{REF}$. Thus, the internal power supply voltage $V_{INT}$ is supplied to an internal circuit (not shown) which requires the internal power supply voltage $V_{INT}$ which is lower than an external power supply voltage $V_{EXT}$.

In more detail, the reference voltage generating circuit 1 is constructed by a voltage divider formed by resistors 101, 102 and 103 and N-channel MOS transistors 104, 105 and 106, and a driver formed by a P-channel MOS transistor 107. In this case, the resistor 102 is shunted by the transistor 104 which is controlled by the control signal PLVCC1.

In a normal operation mode, the control voltage PLVCC1 is made high. Therefore, the transistor 104 is turned ON, so that the reference voltage $V_{RO}$ is made high. On the other hand, in a low voltage margin test mode, the control voltage PLVCC1 is made low. Therefore, the transistor 104 is turned OFF, so that the reference voltage $V_{RO}$ is made low. Note that the reference voltage $V_{RO}$ is lower than the external voltage $V_{EXT}$ both in the normal operation mode and the low voltage margin test.

The internal power supply reference voltage generating circuit 2 is constructed by a differential amplifier formed by P-channel MOS transistors 201 and 202, N-channel MOS transistors 203 and 204 and an N-channel MOS transistor (current source) 205, a driver formed by a P-channel MOS transistor 206, and a voltage divider formed by resistors 207 and 208. For example, if the ratio of the resistance value of the resistor 207 to the resistor 208 is 1, the differential amplifier (201 to 205) receives the reference voltage $V_{RO}$ and the output signal, i.e., half of the internal power supply reference voltage $V_{REF}$. In this case, since half of the internal power supply reference voltage $V_{REF}$ is negatively fed back to the differential amplifier (201 to 205), $V_{REF}/2$ is brought close to $V_{RO}$.

The internal power supply voltage generating circuit 3 is constructed by a differential amplifier formed by P-channel MOS transistors 301 and 302, N-channel MOS transistors 303 and 304 and an N-channel MOS transistor (current source) 305, and a driver formed by a P-channel MOS transistor 306. The differential amplifier (301 to 305)

receives the internal power supply reference voltage $V_{REF}$ and the output signal, i.e., the internal power supply voltage $V_{INT}$. In this case, since the internal power supply voltage $V_{INT}$ is negatively fed back to the differential amplifier (301 to 305), $V_{INT}$ is brought close to $V_{REF}$.

In the internal power supply voltage control apparatus of FIG. 1, however, since the externally-provided pad for the control signal PLVCC1 is necessary, the apparatus would be increased in size. Also, it is impossible to accurately confirm the actual internal power supply voltage $V_{INT}$ for the low voltage margin test mode. Further, since the internal power supply voltage $V_{INT}$ for the low voltage margin test mode is fixed by the resistors 207 and 208, it is impossible to determine a lower limit of the low voltage margin test mode.

Figure 2:
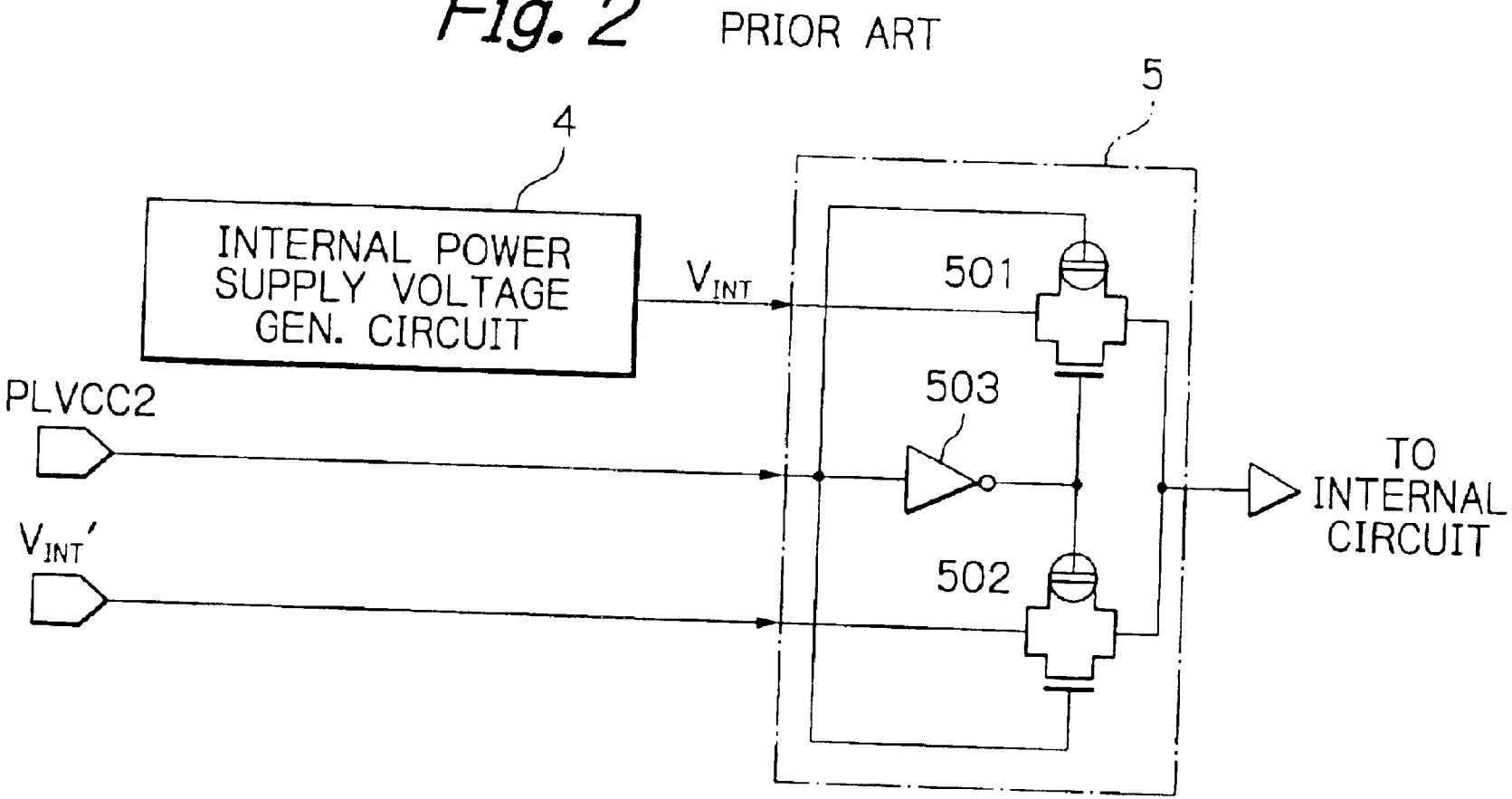
Fig. 2 PRIOR ART
FIG. 2 is a circuit diagram illustrating a second prior art internal power supply voltage control apparatus.

In FIG. 2, which illustrates a second prior art internal power supply voltage control apparatus (see: JP-A-5-33116), an internal power supply voltage generating circuit 4 for generating an internal power supply voltage $V_{INT}$ for a normal operation mode and an externally-provided pad to which an internal power supply voltage $V_{INT}$ for a voltage margin test mode is applied are switched by a selecting circuit 5 which is formed by transfer gates 501 and 502 and an inverter 503.

That is, in a normal operation mode, a control voltage PLVCC2 is made low. Therefore, the transfer gates 501 and 502 are turned ON and OFF, respectively, so that the internal power supply voltage $V_{INT}$ is selected and supplied to the internal circuit. Oil the other hand, in a voltage margin test mode, the control voltage PLVCC2 is made high. Therefore, the transfer gates 501 and 502 are turned OFF and ON, respectively, so that the internal power supply voltage $V_{INT}'$ is selected and supplied to the internal circuit.

Thus, in the internal power supply voltage control apparatus of FIG. 2, since the internal power supply voltage $V_{INT}'$ can be changed, not only a lower limit of the low voltage margin test mode but also a high voltage margin test mode such as a burn-in test mode or a stress test mode can be determined.

In the internal power supply voltage control apparatus of FIG. 2, however, since the two externally-provided pads for the control signal PLVCC2 and the internal power voltage $V_{INT}'$ are necessary, the apparatus would be increased in size.

In the internal power supply voltage control apparatus of FIG. 2, the control signal PLVCC2 can be supplied from an address input pad (see: JP-A-3-160699); in this case, the number of externally-provided pads can be decreased. However, the externally-provided pad for the internal power supply voltage $V_{INT}'$ is still necessary. Additionally, even in a normal operation mode, when overshoot or undershoot occurs in the above-mentioned address input pad, the transfer gate 502 may be turned ON, so that the voltage $V_{INT}'$ interferes with the internal power supply voltage $V_{INT}$.

Figure 3:
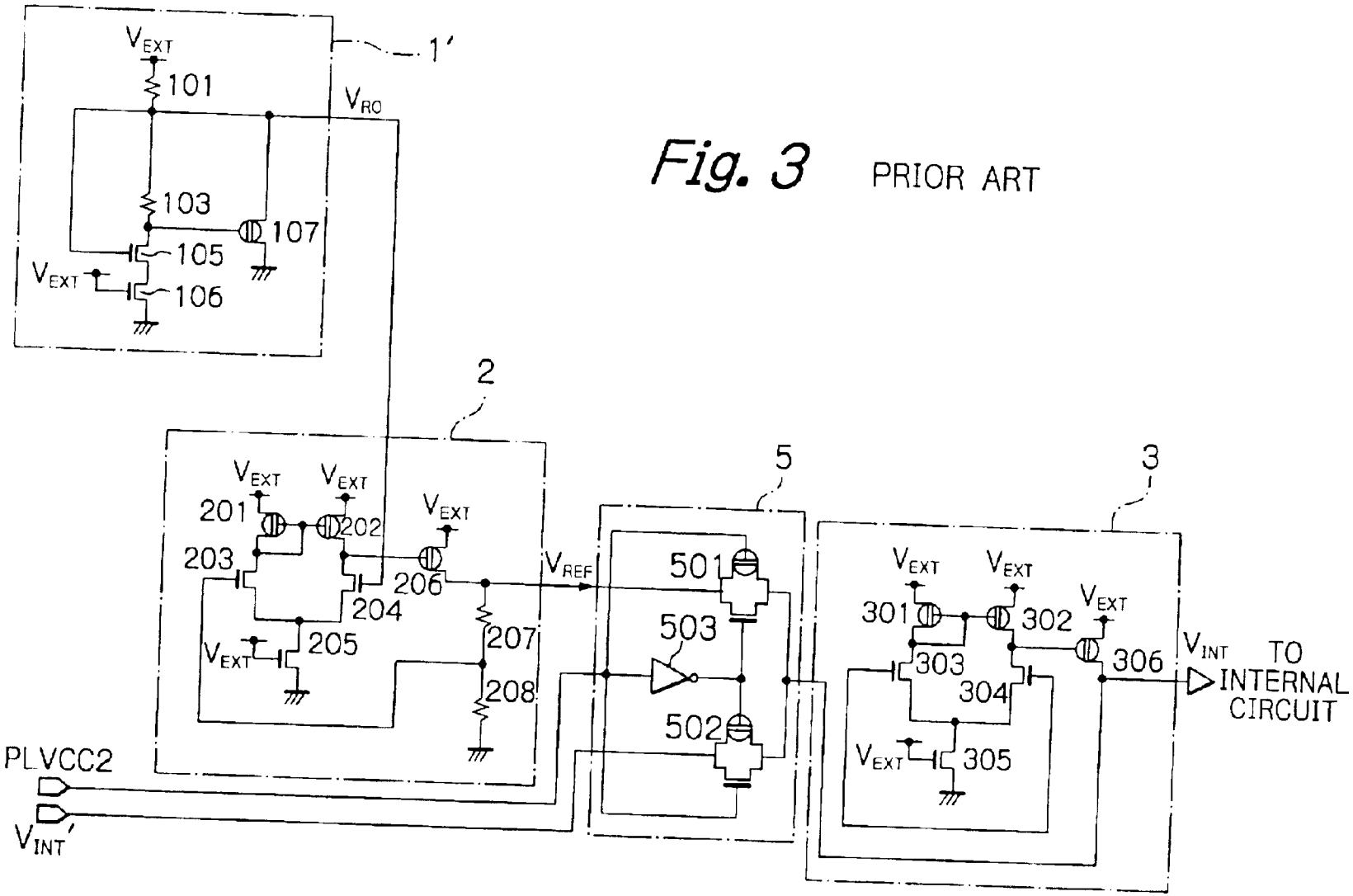
Fig. 3 PRIOR ART
FIG. 3 is a circuit diagram illustrating a third prior art internal power supply voltage control apparatus.

In FIG. 3, which illustrates a third prior art internal power supply voltage control apparatus, the internal power supply voltage control apparatus of FIG. 1 is combined with the internal power supply control apparatus of FIG. 2. In this case, the reference voltage generating circuit 1 of FIG. 1 is modified into a reference voltage generating circuit 1 where the resistor 102 and the transistor 104 are deleted, and the internal power supply voltage generating circuit 4 of FIG. 2 is replaced by the reference voltage generating circuit 1' and the internal power supply reference voltage generating circuit 2 of FIG. 1.

Even in the internal power supply voltage control apparatus of FIG. 3, however, since the two externally-provided pads for the control signal PLVCC2 and the internal power voltage $V_{INT}'$ are necessary, the apparatus would be increased in size.

Figure 4:
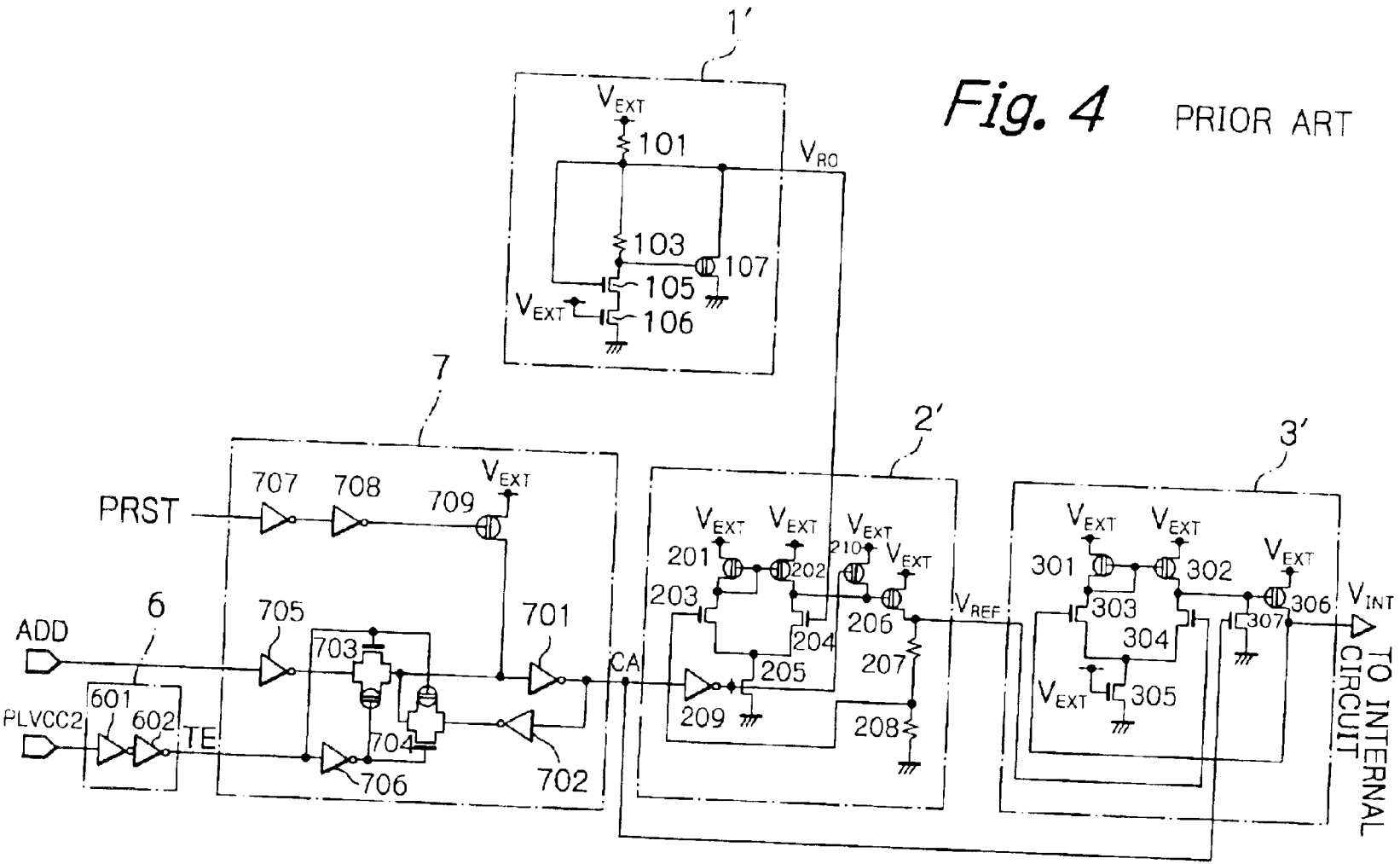
Fig. 4 PRIOR ART
FIG. 4 is a circuit diagram illustrating a fourth prior art internal power supply voltage control apparatus.

In FIG. 4, which illustrates a fourth prior art internal power supply voltage control apparatus, the selecting circuit 5 of FIG. 3 is replaced by a test mode entry circuit 6 and a test mode selecting circuit 7. Also, the internal power supply reference voltage generating circuit 2 of FIG. 3 is modified into an internal power supply reference voltage generating circuit 2' where an inverter 209 and a P-channel MOS transistor 210 controlled by a canceling signal CA of the test mode selecting circuit 7 are added. Further, the internal power supply voltage generating circuit 3 of FIG. 3 is modified into an internal power supply voltage generating circuit 3' where an N-channel MOS transistor 307 controlled by the canceling signal CA of the test mode selecting circuit 7 is added.

The test mode entry circuit 6 is constructed by a series of two inverters 601 and 602 for receiving a control signal PLVCCZ for a voltage margin test mode to generate a test mode entry signal TE.

The test mode selecting circuit 7 is constructed by a latch circuit formed by two inverters 701 and 702, transfer gates 703 and 704 for writing a predetermined address signal ADD into the latch circuit (701, 702) in accordance with the test mode entry signal TE, and inverters 705 and 706 for receiving the predetermined address signal ADD and the test mode entry signal TE, respectively. Also, inverters 707 and 708 and a P-channel MOS transistor 709 are connected to the latch circuit (701, 702), so that the latch circuit (701, 702) is initialized by a power-on reset signal PRST.

The operation of the test mode selecting circuit 7 of FIG. 4 will be explained below.

First, when the power is turned ON, the power-on reset signal PRST is temporarily made low to turn ON the transistor 709. As a result, the latch circuit (701, 702) is initialized, i.e., the canceling signal CA is made low. Thereafter, the power-on reset signal PRST returns high.

In a normal operation mode, the control signal PLVCC2 is low so that the test mode entry TE is low. Therefore, the latch circuit maintains the same state, i.e., the canceling signal CA is low, regardless of the predetermined address signal ADD.

In a voltage margin test mode, the control signal PLVCC2 is made high so that the test mode entry signal TE is made high. Simultaneously, the voltage of the predetermined address signal ADD is made high. Therefore, the state of the latch circuit (701, 702) is changed, i.e., the canceling signal CA is made high.

Thus, in a normal operation mode, the canceling signal CA is low. On the other hand, in a voltage margin test mode, the canceling signal CA is high.

In a normal operation mode, since the canceling signal CA is low, the transistors 205 and 210 are turned ON and OFF, respectively, so that the internal power supply reference voltage generating circuit 2' operates in the same way as in the internal power supply reference voltage generating circuit 2 of FIG. 1. Additionally, The transistor 307 is turned OFF, so that the internal power supply voltage generating circuit 3' operates in the same way as in the internal power supply reference voltage generating circuit 3 of FIG. 1.

In a voltage margin test mode, since the canceling signal CA is high, the transistors 205 and 210 are turned OFF and ON, respectively, so that the internal power supply reference voltage generating circuit 2' is deactivated. Additionally, the transistor 307 is turned ON, so that the internal power supply voltage generating circuit 3' is also deactivated. In this case, the transistor 306 is completely turned ON by the turning-ON of transistor 307. Therefore, if a low voltage or a high voltage as a voltage margin test mode is applied to an external pad for the external voltage, such a low voltage or such a high voltage is supplied via the transistor 306 to the internal circuit. Thus, an arbitrary voltage margin test can be carried out without the externally-provided pad for the internal power supply voltage $V_{INT}'$ of FIG. 3 while the externally-provided pad for the control signal PLVCC2 is necessary.

Thus, in the internal power supply voltage control apparatus of FIG. 4, in a voltage margin test mode, since the external voltage $V_{EXT}$ can be low or high, not only a low voltage margin test but also a high voltage margin test such as a burn-in test or a stress test can be carried out.

In the internal power supply voltage control apparatus of FIG. 4, however, in a voltage margin test mode, a circuit portion such as a peripheral circuit operated directly by the external voltage $V_{EXT}$ is also subjected to a low voltage or a high voltage for the voltage margin test mode, so that it is impossible to accurately determine a lower limit of the low voltage margin test mode and an upper limit of the high voltage margin test mode.

Figure 5:
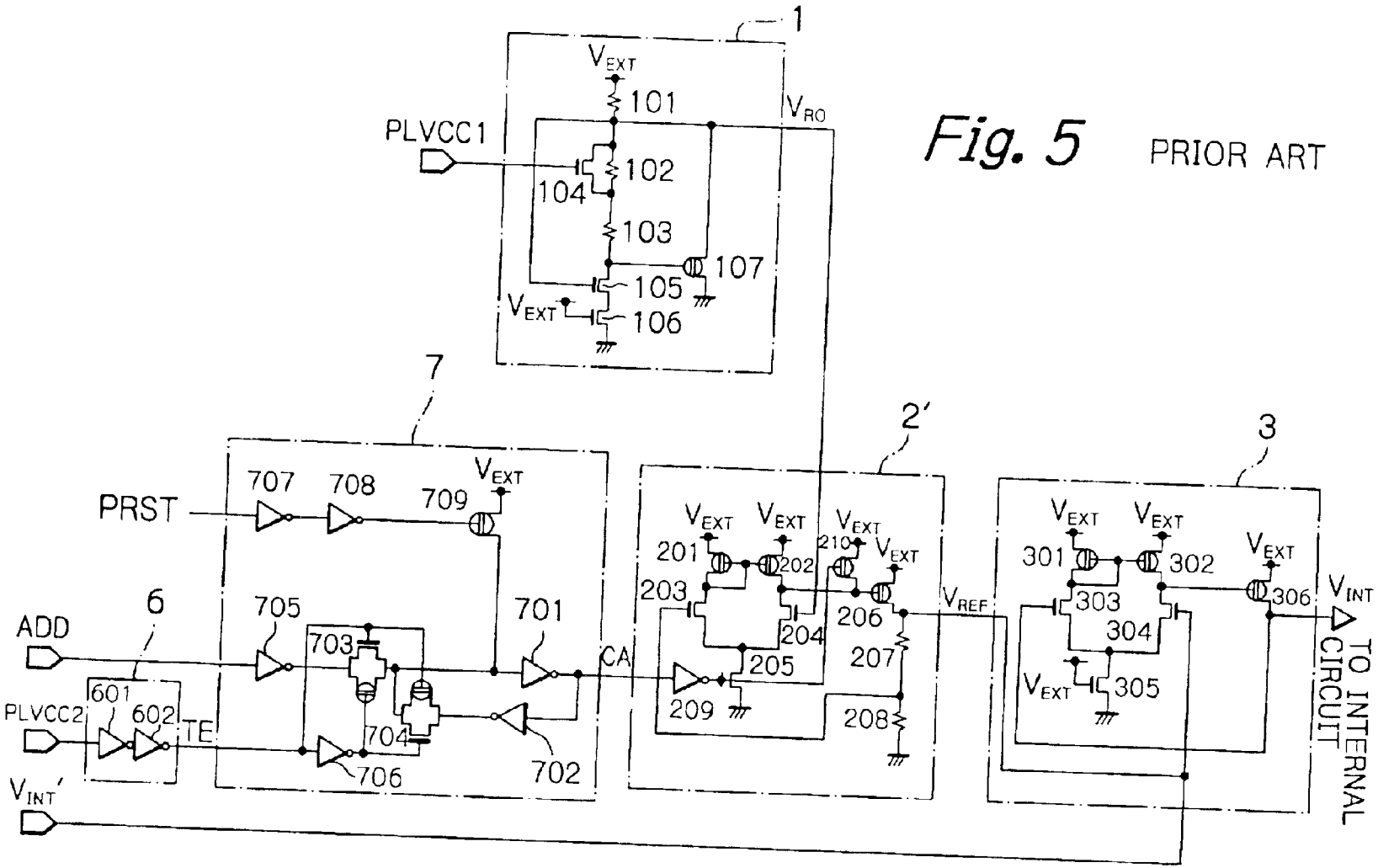
Fig. 5 PRIOR ART
FIG. 5 is a circuit diagram illustrating a fifth prior art internal power supply voltage control apparatus.

In FIG. 5, which illustrates a fifth internal power supply voltage apparatus, the reference voltage generating circuit 1' of FIG. 4 is replaced by the reference voltage generating circuit 1 of FIG. 1. Also, the internal power supply voltage generating circuit 3' of FIG. 4 is replaced by the internal power supply voltage generating circuit 3 of FIG. 1. Further, an internal power supply voltage $V_{INT}'$ for a voltage margin test mode is applied from an externally-provided pad to the gate of the transistor 304 of the internal power supply voltage generating circuit 3.

In FIG. 5, the control signal PLVCC1 is used for testing a completed semiconductor device (chip), i.e., an assembled semiconductor device (chip). On the other hand, the control signal PLVCC2 is used for testing an incomplete semiconductor device (chip), i.e., a semiconductor device in a wafer state. Therefore, in the complete semiconductor device, a wire bonding operation is performed upon the externally-provided pad for PLVCC1 while no wire bonding operation is performed upon the externally-provided pad for PLVCC2.

In a normal operation mode, PLVCC1=PLVCC2=low and $V_{INT}'$="floating state". Therefore, the canceling signal CA is low. Thus, the transistors 205 and 210 are turned ON and OFF, respectively, so that the internal power supply reference voltage generating circuit 2' operates in the same way as in the internal power supply reference voltage generating circuit 2 of FIG. 1. Additionally, since the externally-provided pad for the internal power supply voltage $V_{INT}'$ is in a floating state, the internal power supply voltage generating circuit 3 operates in the same way as in the internal power supply voltage generating circuit 3 of FIG. 1.

In a voltage margin Lest mode, PLVCC2=high. Therefore, the canceling signal CA is high. Thus, the transistors 205 and 210 are turned OFF and ON, respectively, so that the internal power supply reference voltage generating circuit 2' is deactivated. Additionally, a low voltage or a high voltage is supplied as the internal power supply voltage $V_{INT}'$ to the gate of the transistor 304 in the internal power supply voltage generating circuit 3. Therefore, the internal power supply voltage $V_{INT}$ is brought close to the above-mentioned low voltage or high voltage as a voltage margin test mode, and thus, an arbitrary voltage margin test can be carried out while the externally-provided pads for the control signal PLVCC2 and the internal power supply voltage $V_{INT}'$ are necessary.

In the apparatus of FIG. 5, however, after a semiconductor device (chip) is completed, no use is made of the internal power supply voltage $V_{INT}'$ due to no wire bonding operation upon the pad thereof, so that a high voltage margin test mode such as a burn-in test or a stress test cannot be carried out.

Figure 6:
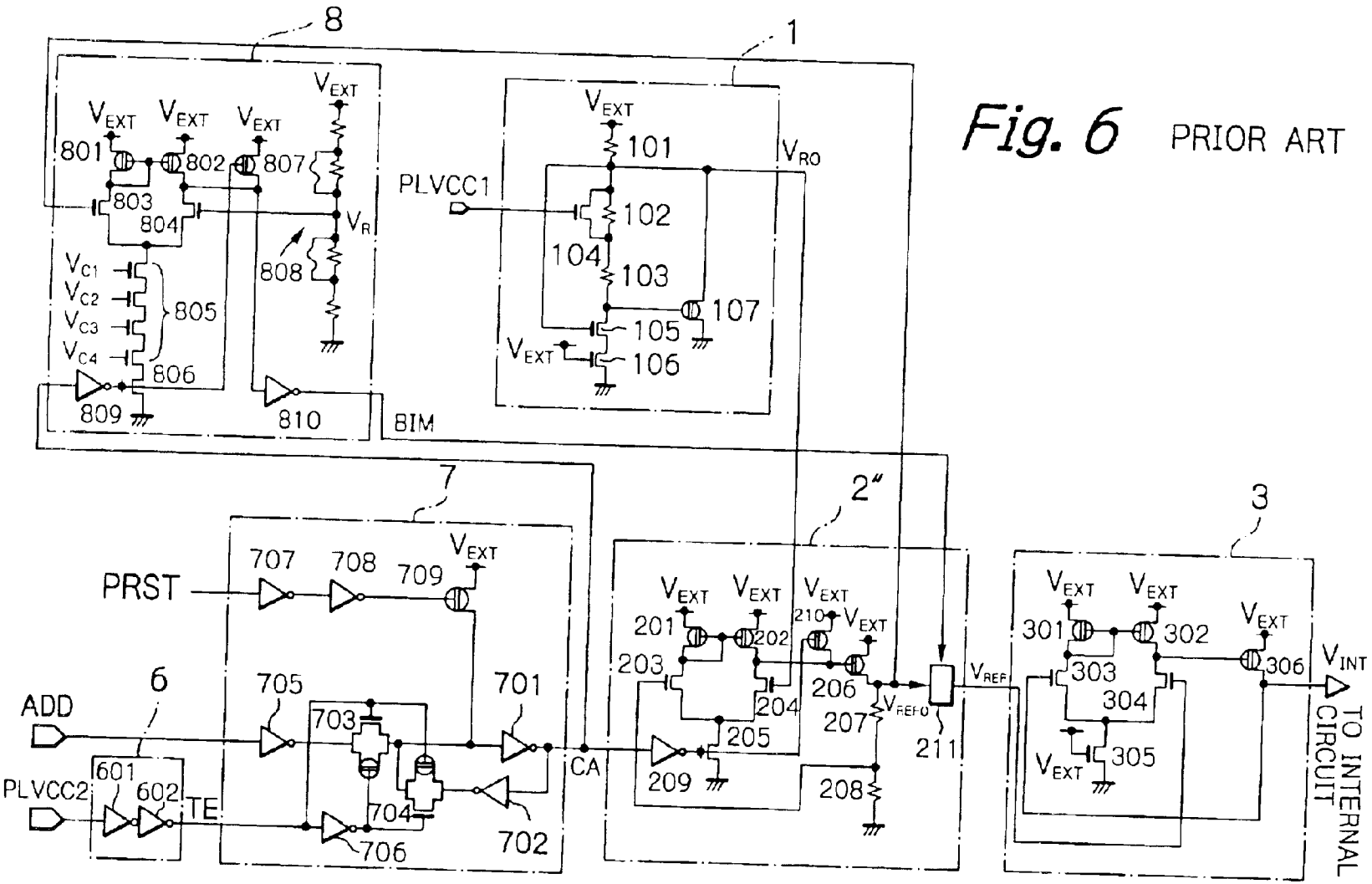
Fig. 6 PRIOR ART
FIG. 6 is a circuit diagram illustrating a sixth prior art internal power supply voltage control apparatus.

In FIG. 6, which illustrates a sixth prior art internal power supply voltage control apparatus, the internal power supply reference voltage generating circuit 2' of FIG. 5 is modified into an internal power supply reference voltage generating circuit 2" where a voltage step-up circuit 211 is added. Also, the pad for the internal power supply voltage $V_{INT}'$ of FIG. 5 is deleted. Further, a burn-in test mode circuit 8 is added to the elements of the apparatus of FIG. 5.

The burn-in test mode circuit 8 generates a burn-in test mode signal BIM and transmits it to the voltage step-up circuit 211, thus carrying out a burn-in test operation.

The burn-in test mode circuit 8 is constructed by a differential amplifier formed by P-channel MOS transistors 801 and 802, N-channel MOS transistors 803 and 804, a series of N-channel MOS transistors 805 whose gates receive constant voltages $V_{C1}$, $V_{C2}$, $V_{C3}$ and $V_{C4}$, an N-channel MOS transistor 806, a precharging P-channel MOS transistor 807, a voltage divider formed by resistors, and inverters 809 and 810. The differential amplifier (801 to 806) receives the voltage $V_{REFO}$ before the voltage step-up circuit 211 of the internal power supply reference voltage generating circuit 2" and the reference voltage $V_R$ of the voltage divider 808.

In a normal operation mode, the control signal PLVCC2 is made low so that the canceling signal CA is low. As a result, the transistors 806 and 809 are turned ON and OFF, respectively, thus activating the differential amplifier (801 to 806). In this case, the voltage $V_R$ is set to be lower than the voltage $V_{REFO}$. Therefore, the output signal of the differential amplifier (801 to 806) is made high, so that the burn-in test mode signal BIM is made low, thus deactivating the voltage step-up circuit 211. That is, $V_{REF}=V_{REFO}$.

Even in a burn-in test mode, the control signal PLVCC2 is made low so that the canceling signal CA is low. As a result, the transistors 806 and 809 are turned ON and OFF, respectively, thus activating the differential amplifier (801 to 806). In this case, the external voltage $V_{EXT}$ is raised to be higher than the voltage $V_{REFO}$. Therefore, the output signal of the differential amplifier (801 to 806) is made low, so that the burn-in test mode signal BIM is made high, thus activating the voltage step-up circuit 211. That is, $V_{REF}>V_{REFO}$, i.e., $V_{INT}>V_{REFO}$, by which the internal circuit enters in a burn-in test mode.

For example, when the guaranteed range of operation is 3.0V to 3.6V, the breakdown voltage of transistors operated at $V_{EXT}$ is 4.5V and the breakdown voltage of transistors operated at $V_{INT}$ is 2.5V, the internal power supply reference voltage $V_{REF}$ is set to be 2.0V for a normal operation mode. Then, in a burst-in test mode, the voltage $V_R$ at the voltage divider 808 is increased by $V_{EXT}$ to about 4.0V, thus activating the voltage step-up circuit 211.

In the apparatus of FIG. 6, however, when the breakdown voltage of transistors varies due to the fluctuation of manufacturing processes or the like, the voltage margin between the external voltage $V_{EXT}$ in a burn-in test mode and the guaranteed range of operation is decreased, so that it is impossible to surely carry out a burn-in test.

Figure 7:
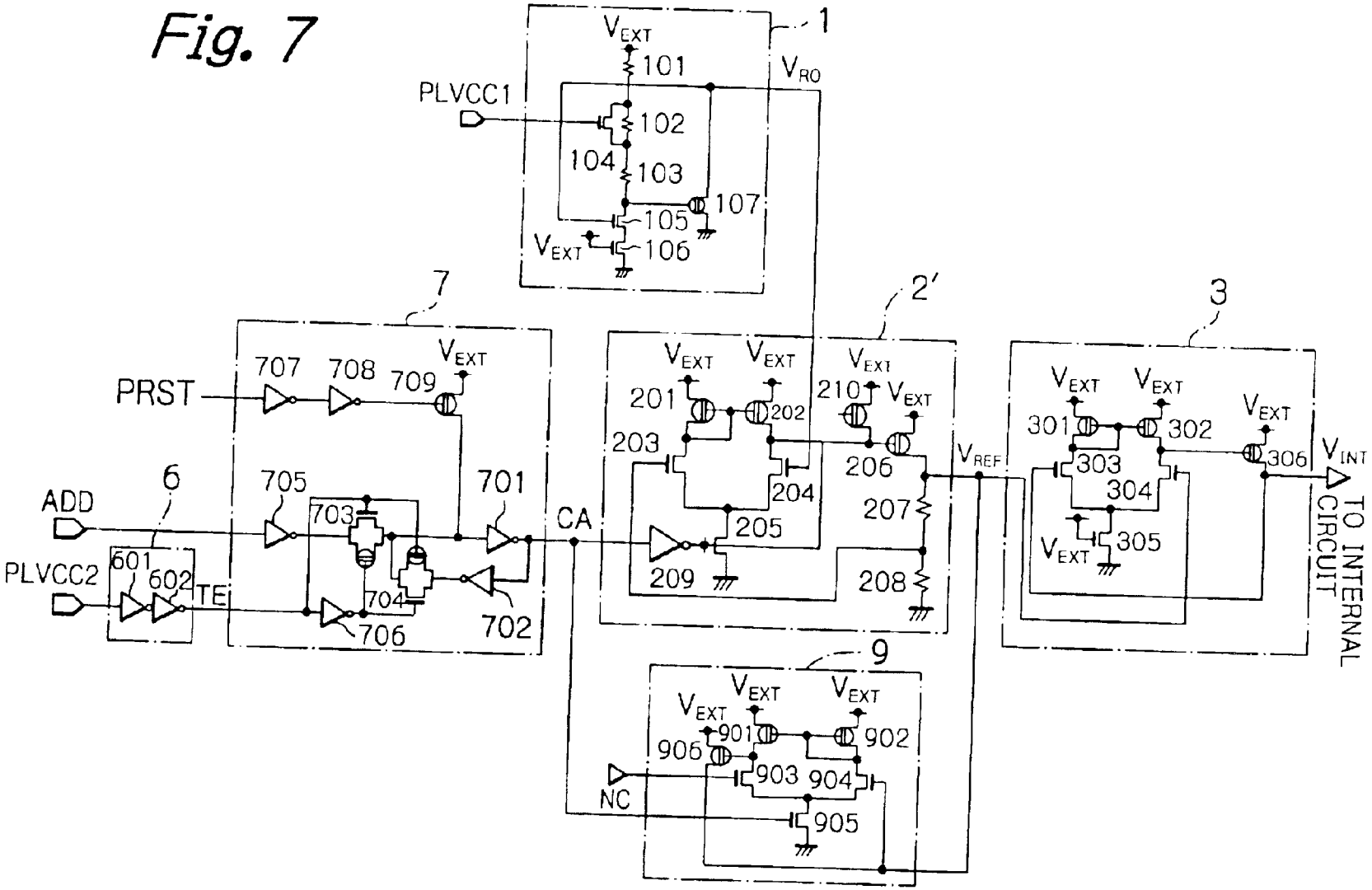
FIG. 7 is a circuit diagram illustrating a first embodiment of the internal power supply voltage control apparatus according to the present invention.

In FIG. 7, which illustrates a first embodiment of the internal power supply voltage control apparatus according to the present invention, another internal power supply reference voltage generating circuit 9 is provided instead of the externally-provided pad for the internal power supply voltage $V_{INT}$' of FIG. 5.

The internal power supply reference voltage generating circuit 9 is connected in parallel with the internal power supply reference voltage generating circuit 2'. Additionally, one of the internal power supply reference voltage generating circuits 2' and 9 is activated by the canceling signal CA of the test mode selecting circuit 7.

The internal power supply reference voltage generating circuit 9 is constructed by a differential amplifier formed by a P-channel MOS transistors 901 and 902, N-channel MOS transistors 903 and 904 and an N-channel MOS transistor (current source) 905, and a driver formed by a P-channel MOS transistor 906. The differential amplifier (901 to 905) receives a voltage at a non-connection pad NC and the output signal, i.e., the internal power supply reference voltage $V_{REF}$. In this case, since the internal power supply reference voltage $V_{REF}$ is negatively fed back to the differential amplifier (901 to 905), $V_{REF}$ is brought close to the voltage at the non-connection pad NC.

Note that no wire bonding operation is performed upon the non-connection pad NC even after a semiconductor device (chip) is completed.

In a normal operation mode, PLVCC1=PLVCC2=low. Therefore, the canceling signal CA is low, so that the internal power supply reference voltage generating circuit 2' is selected and activated. That is, in the internal power supply reference voltage generating circuit 2', the transistors 205 and 210 are turned ON and OFF, respectively, so that the internal power supply reference voltage generating circuit 2' operates in the same way as in the internal power supply reference voltage generating circuit 2 of FIG. 1. The internal power supply voltage generating circuit 3 operates in accordance with the internal power supply reference voltage $V_{REF}$ of the internal power supply reference voltage generating circuit 2'.

In a voltage margin test mode, PLVCC2=high. Therefore, the canceling signal CA is high, so that the internal power supply reference voltage generating circuit 9 is selected and activated. That is, in the internal power supply reference voltage generating circuit 9, the transistor 905 is turned ON, so that a difference between the voltage at the non-connection pad NC and the output signal, i.e., the internal power supply reference voltage $V_{REF}$ is amplified. Thus, $V_{REF}$ is brought close to the voltage at the non-connection pad NC. Therefore, if a low voltage or a high voltage is supplied to the non-connett ion pad NC of the internal power supply reference voltage generating circuit 9, the internal power supply voltage $V_{INT}$ is brought close to the above-mentioned low voltage or high voltage as a voltage margin test mode, and thus, an arbitrary voltage margin test can be carried out while the externally-provided pad for the control signal PLVCC2 is necessary.

Figure 8:
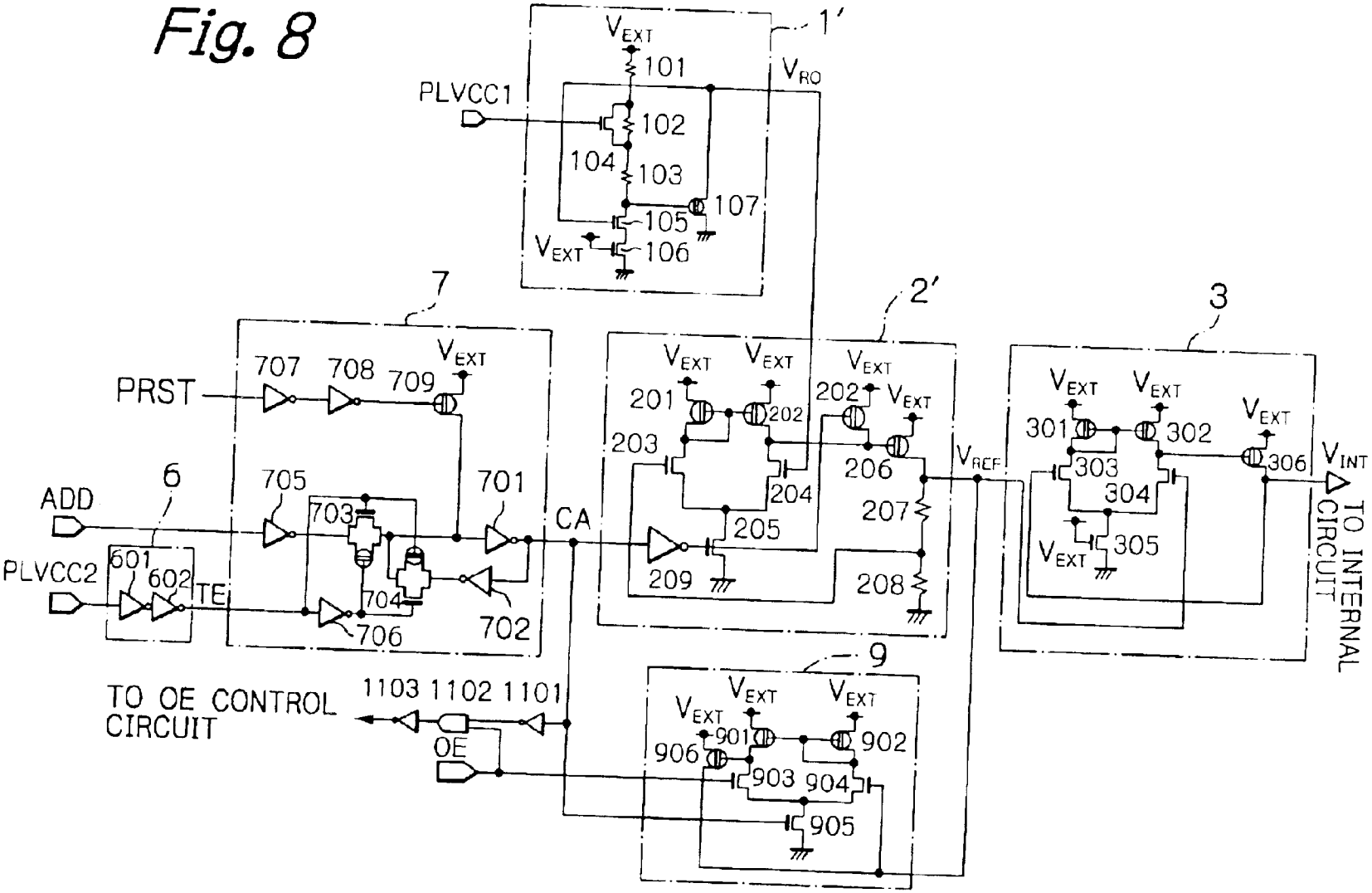
FIG. 8 is a circuit diagram illustrating a second embodiment of the internal power supply voltage control apparatus according to the present invention.

In FIG. 8, which illustrates a second embodiment of the internal power supply voltage control apparatus according to the present invention, the internal power supply reference voltage generating circuit 9 of FIG. 7 is modified into an internal power supply reference voltage generating circuit 9' where the non-connection pad NC of FIG. 7 is not provided. That is, an externally-provided input/output pad such as an output enable pad OE is used as the non-connection pad NC. In this case, an inverter 1101 a NAND circuit 1102 and an inverter 1103 are provided. That is, the inverter 1101 receives the canceling signal CA, the NAND circuit 1102 is connected to the inverter 1101 and the output enable pad OE, and the inverter 1103 is connected to the NAND circuit 1102.

In a normal operation mode, since the canceling signal CA is low, the voltage at the output enable pad OE passes through the NAND circuit 1102 and the inverter 1103 to an output enable control circuit (not shown), thus activating the output enable control circuit. On the other hand, in a voltage margin test mode, since the canceling signal CA is high, the voltage at the output enable pad OE does not pass through the NAND circuit 1102 and the inverter 1103 to the output enable control circuit, thus deactivating the output enable control circuit.

In FIG. 8, another external-provided input/output pad such as a chip select pad CS can be used instead of the output enable pad OE.

Thus, in FIG. 7 and 8, since the voltage at the non-connection pad NC or at the predetermined control pad such as OE or CS can be low or high, a low voltage margin test and a high voltage margin test such as a burn-in test or a stress test can be carried out without additional externally-provided pads. Note that the non-connection pad NC and the control pads OE and CS are conventionally provided in a semiconductor device.

Even in FIGS. 7 and 8, a predetermined low voltage margin test mode can also be carried out, under the condition that the control signal VLVCC1 is low. However, since such a predetermined low voltage margin test can be carried out by using the non-connection pad NC of FIG. 7 or the control pad of FIG. 8, the reference voltage generating circuit 1 can be replaced by the reference voltage generating circuit 1' of FIG. 3.

Figure 9:
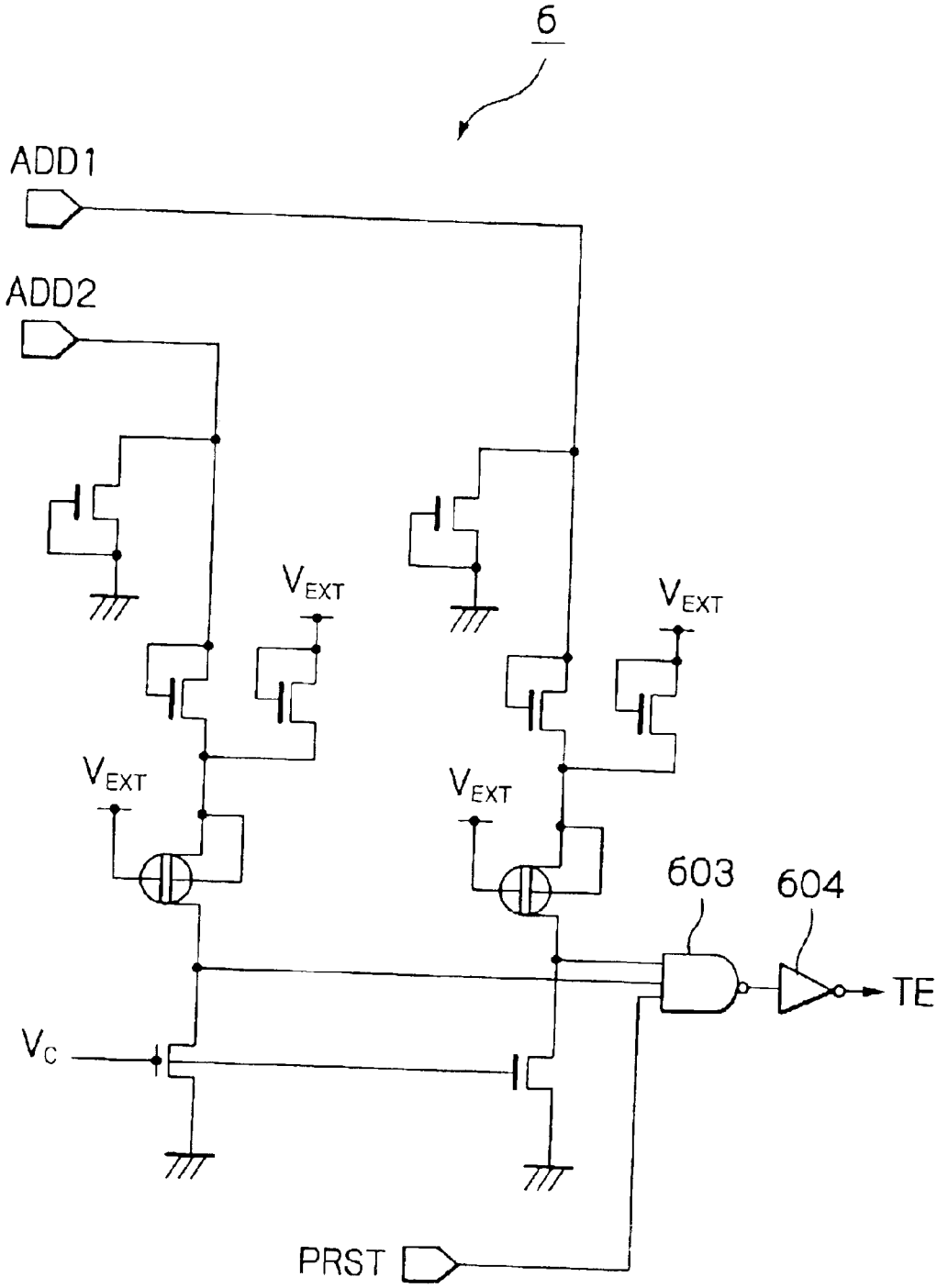
FIG. 9 is a circuit diagram illustrating a modification of the test mode entry circuit of FIGS. 7 and 8.

In FIG. 9, which illustrates a modification of the test mode entry circuit 6 of FIGS. 7 and 8, a super voltage type test mode entry circuit is used. That is, only when voltages at predetermined address pads ADD1 and ADD2 are much higher than a predetermined value, is the test mode entry signal TE generated while the generation of the test mode entry signal TE is prohibited by the power on reset signal PRST. In FIG. 9, no predetermined pad for a voltage margin test mode is necessary.

As explained hereinabove, according to the present invention, a low voltage margin test and a high voltage margin test such as a burn-in test or a stress test can be accurately carried out without additional externally-provided pads.

What is claimed is:

1. An internal power supply voltage control apparatus comprising:

a reference voltage generating circuit for generating a reference voltage;

a first internal power supply reference voltage generating circuit, connected to said reference voltage generating circuit, for generating a first internal power supply reference voltage in accordance with said reference voltage;

a second internal power supply reference voltage generating circuit for generating a second internal power supply reference voltage in accordance with a voltage applied to a predetermined pad;

a test mode selecting circuit, connected to said first and second internal power supply reference voltage generating circuits, for activating one of said first and second internal power supply reference voltage generating circuits in accordance with a control signal; and an internal power supply voltage generating circuit, connected to said first and second internal power supply reference voltage generating circuits, for generating an internal power supply voltage in accordance with one of said first and second internal power supply reference voltages generated from an activated one of said first and second internal power supply reference voltage generating circuits.

2. The internal power supply voltage control apparatus as set forth in claim 1, wherein said first internal power supply reference voltage generating circuit comprises:

a first differential amplifier;

a first driver, connected to said first differential amplifier, for receiving an output signal of said first differential amplifier to generate said first internal power supply reference voltage;

a voltage divider, connected to said first driver, for dividing said first internal power supply reference voltage, said first differential amplifier receiving said reference voltage and an output signal of said voltage divider, so that the output signal of said voltage divider is brought close to said reference voltage, said first differential amplifier and said first driver being activated by said test mode entry circuit.

3. The internal power supply voltage control apparatus as set forth in claim 1, wherein said second internal power supply reference voltage generating circuit comprises:

a second differential amplifier; and a second driver, connected to said second differential amplifier, for receiving an output signal of said second differential amplifier to generate said second internal power supply reference voltage, said second differential amplifier receiving the voltage at said predetermined pad and an output signal of said second driver, so that the output signal of said second driver is brought close to the voltage at said predetermined pad, said second differential amplifier being activated by said test mode entry circuit.

4. The internal power supply voltage control apparatus as set forth in claim 1, wherein said internal power supply voltage generating circuit comprises:

a third differential amplifier; and a third driver, connected to said third differential amplifier, for receiving an output signal of said third differential amplifier to generate said internal power supply voltage, said third differential amplifier receiving an output signal of one of said first and second internal power supply reference generating circuit and an output signal of said third driver, so that the internal power supply voltage is brought close to the output signal of the one of said first and second power supply reference voltage generating circuits.

5. The internal power supply control apparatus as set forth in claim 1, wherein said predetermined pad comprises a non-connection pad.

6. The internal power supply control apparatus as set forth in claim 1, wherein said predetermined pad comprises a control pad.

7. The internal power supply control apparatus as set forth in claim 6, further comprising a gate circuit, connected to said test mode selecting circuit and said control pad, for passing the voltage at said control pad when said first internal power supply voltage generating circuit is activated.

8. The internal power supply voltage control apparatus as set forth in claim 1, wherein the voltage at said predetermined pad is a voltage for a low voltage margin test mode.

9. The internal power supply voltage control apparatus as set forth in claim 1, wherein the voltage at said predetermined pad is a voltage for a high voltage margin test mode.

10. The internal power supply voltage control apparatus as set forth in claim 1, wherein the voltage at said predetermined pad is a voltage for a burn-in test mode.

* * * * *